US007717547B2

(12) United States Patent
Taira

(10) Patent No.: US 7,717,547 B2
(45) Date of Patent: May 18, 2010

(54) INKJET HEAD

(75) Inventor: Hiroshi Taira, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 587 days.

(21) Appl. No.: 11/385,912

(22) Filed: Mar. 22, 2006

(65) Prior Publication Data

US 2006/0227174 A1 Oct. 12, 2006

(30) Foreign Application Priority Data

Mar. 22, 2005 (JP) ..... 2005-081914
Nov. 9, 2005 (JP) ..... 2005-324919

(51) Int. Cl.
*B41J 2/175* (2006.01)
*B41J 2/05* (2006.01)
*B41J 2/145* (2006.01)

(52) U.S. Cl. ..... 347/85; 347/65; 347/40

(58) Field of Classification Search ..... 347/85, 347/65, 40

See application file for complete search history.

(56) References Cited

U.S. PATENT DOCUMENTS

| | | | | |
|---|---|---|---|---|
| 2002/0171711 | A1 | 11/2002 | Okuda et al. | |
| 2003/0090540 | A1 | 5/2003 | Shimizu | |
| 2005/0036005 | A1* | 2/2005 | Chikamoto | 347/65 |
| 2005/0036017 | A1* | 2/2005 | Chikamoto et al. | 347/93 |
| 2005/0046681 | A1* | 3/2005 | Kumagai et al. | 347/85 |
| 2005/0083379 | A1 | 4/2005 | Chikamoto | |

FOREIGN PATENT DOCUMENTS

| | | | |
|---|---|---|---|
| CN | 1579767 | A | 2/2005 |
| EP | 1403063 | A1 | 3/2004 |
| EP | 1506867 | A1 | 2/2005 |
| JP | H06-047913 | A | 2/1994 |
| JP | H09-226113 | A | 9/1997 |
| JP | H11-070650 | A | 3/1999 |
| JP | 2005-059435 | A | 3/2005 |
| JP | 2005 59438 | | 3/2005 |

OTHER PUBLICATIONS

European Patent Office, European Search Report for Related EP Application No. 06005496 dated Sep. 18, 2006.
State Intellectual Property Office, Notification of First Office Action for Chinese Patent Appl'n No. 200610059866.5 (counterpart to above-captioned U.S. patent application) dated Dec. 27, 2007.

* cited by examiner

*Primary Examiner*—Stephen D Meier
*Assistant Examiner*—Sarah Al-Hashimi
(74) *Attorney, Agent, or Firm*—Baker Botts, LLP.

(57) ABSTRACT

An inkjet head includes a flow path unit and a reservoir unit. The reservoir unit stores ink and includes an ink flow path, a reservoir flow path and an ink drop flow path. The reservoir flow path includes a main flow path formed with plural tributary communication ports, and plural tributary flow paths. A section area of the main flow path taken along a width direction of the reservoir unit is larger than each of section areas of the tributary flow paths taken along a direction perpendicular to a flow direction of ink. The ink drop flow path drops ink onto a substantially center of the main flow path as viewed in a plan view. The tributary communication ports are substantially equal to each other in an opening area.

11 Claims, 13 Drawing Sheets

INKJET HEAD

CROSS-REFERENCE TO RELATED APPLICATIONS

This application is based upon and claims the benefit of priorities from Japanese Patent Application No. 2005-81914 filed on Mar. 22, 2005 and Japanese Patent Application No. 2005-324919 filed on Nov. 9, 2005, the entire contents of which are incorporated herein by reference.

BACKGROUND OF THE INVENTION

1. Field of the Invention

The invention relates to an inkjet head, which ejects ink to a recording medium.

2. Description of the Related Art

US 2005/0083379 A1 discloses an inkjet head, which ejects ink from nozzles to a recording medium such as a printing sheet. Specifically, US 2005/0083379 A1 discloses an inkjet head having: a flow path unit, a reservoir unit and an actuator unit. The flow path unit is formed with a common ink chamber and a plurality of individual ink flow path each of which communicates with the common ink chamber and extends to a nozzle through a pressure chamber. The reservoir unit is formed with a reservoir for supplying stored ink to the common ink chamber. The reservoir unit is joined to the flow path unit. The actuator unit imparts ejection energy to the ink in the flow path unit. A plurality of ink supply ports are formed in the flow path unit. A plurality of tributary flow paths, which communicate with the common ink chamber through the respective ink supply ports, are formed in the reservoir. The ink stored in the reservoir is supplied to the common ink chamber through the respective tributary flow paths and the corresponding ink supply ports, which communicate with the respective tributary flow paths (see FIGS. 4 and 5 of US 2005/0083379 A1).

SUMMARY OF THE INVENTION

In the inkjet head of US 2005/0083379 A1, in the process of initially introducing the ink into the inkjet head, ink that has flown into one tributary flow path flows into the common ink chamber through a corresponding ink supply port, and the ink that has flown into the common ink chamber sometimes reaches another ink supply port to which ink from another tributary flow path has not yet reached. At this time, the other ink supply port are blocked by the ink in the common ink chamber, and therefore air accumulation is formed in the tributary flow path communicating with the other ink supply port. When air accumulation is formed in a tributary flow path, the ink flow in the tributary flow path is disturbed. In order to discharge air accumulation from tributary flow paths, a large amount of ink must be supplied to the reservoir.

The invention provides an inkjet head in which, in the process of initially introducing an ink, air accumulation is hardly formed in a tributary flow path.

According to one aspect of the invention, an inkjet head includes a flow path unit and a reservoir unit. The flow path unit includes a plurality of ink supply ports, a common ink chamber and a plurality of individual ink flow paths. Ink flowing from the ink supply ports is supplied into the common ink chamber. Each of the individual ink flow paths extends from an outlet of the common ink chamber to a nozzle through a pressure chamber. The reservoir unit stores the ink. The reservoir unit is joined to the flow path unit so that ink stored in the reservoir unit is supplied to the common ink chamber of the flow path unit through the ink supply ports. The reservoir unit includes an ink inflow path, a reservoir flow path and an ink drop flow path. The ink inflow path is formed with an ink inflow port into which ink flows. The reservoir flow path includes a plurality of ink outflow ports communicating with the ink supply ports. The ink drop flow path is disposed between the ink inflow path and the reservoir flow path. The reservoir flow path includes a main flow path and a plurality of tributary flow paths. The main flow path elongates in a longitudinal direction of the reservoir unit. The main flow path is formed with a plurality of tributary communication ports. Each of the tributary flow paths is formed between a corresponding tributary communication port and a corresponding ink outflow port. A section area of the main flow path taken along a width direction of the reservoir unit is larger than each of section areas of the tributary flow paths taken along a direction perpendicular to a flow direction of ink. The ink drop flow path drops ink flowing from the ink inflow path onto a substantially center of the main flow path as viewed in a plan view. The tributary communication ports are substantially equal to each other in an opening area.

According to this configuration, in a process of initially introducing the ink, the ink, which is dropped from the ink drop flow path onto the center of the main flow path forms flow of ink, which flows from the center of the main flow path toward the both ends, and then flows into the tributary flow paths through the tributary communication ports. At this time, since the tributary communication ports have the same opening area, a substantially same amount of ink flows at a substantially same speed into all of the tributary flow paths through the tributary communication ports. Among all the tributary flow paths, therefore, the difference in time when the ink, which has flown into the tributary flow paths, reaches the common ink chamber through the respective ink supply ports is reduced. Consequently, air accumulation is hardly formed in the tributary flow paths.

DETAILED DESCRIPTION OF EMBODIMENTS OF THE INVENTION

Hereinafter, embodiments of the invention will be described with reference to the accompanying drawings.

Figure 1:
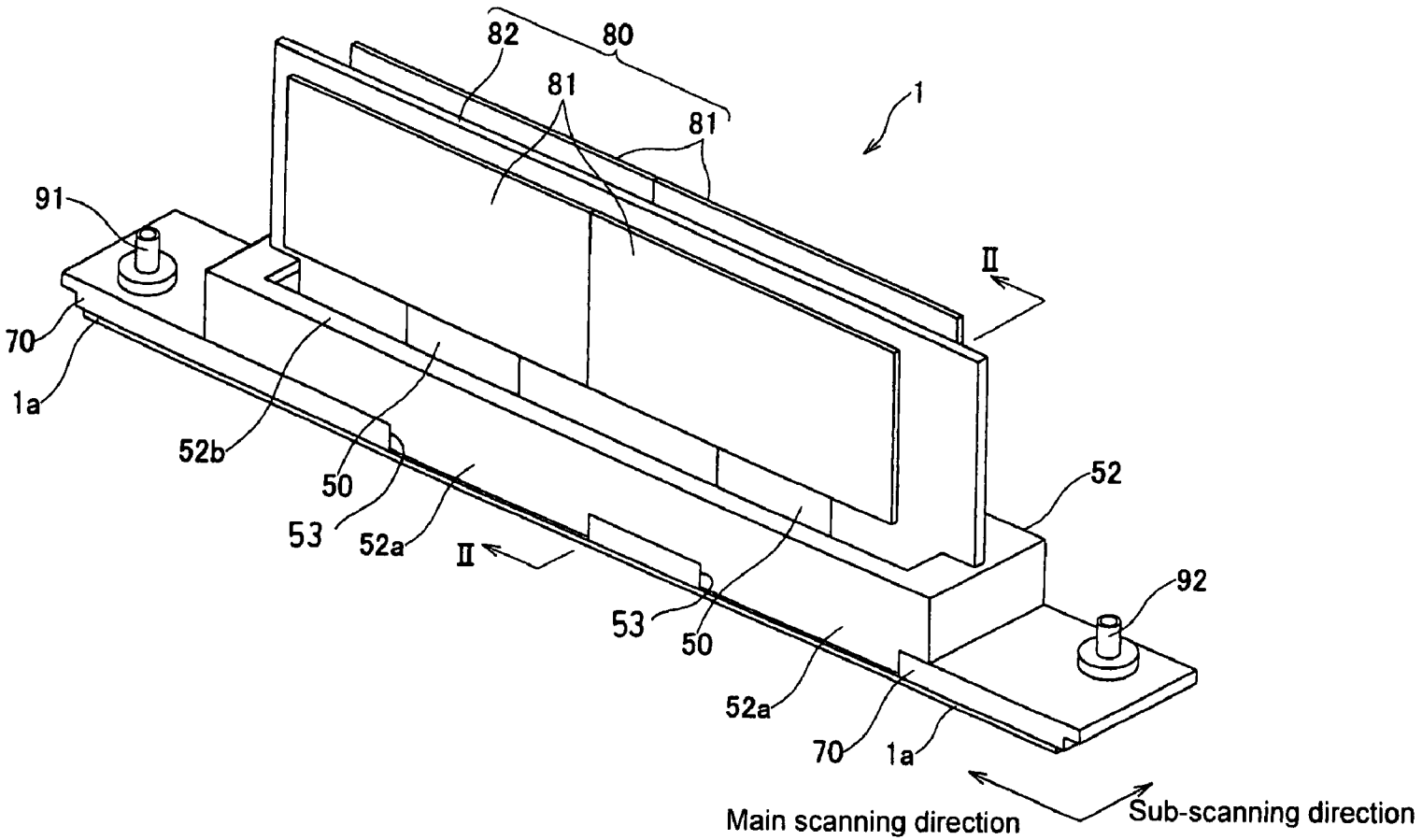
FIG. 1 is a perspective view showing an inkjet head according to one embodiment of the invention.
Figure 2:
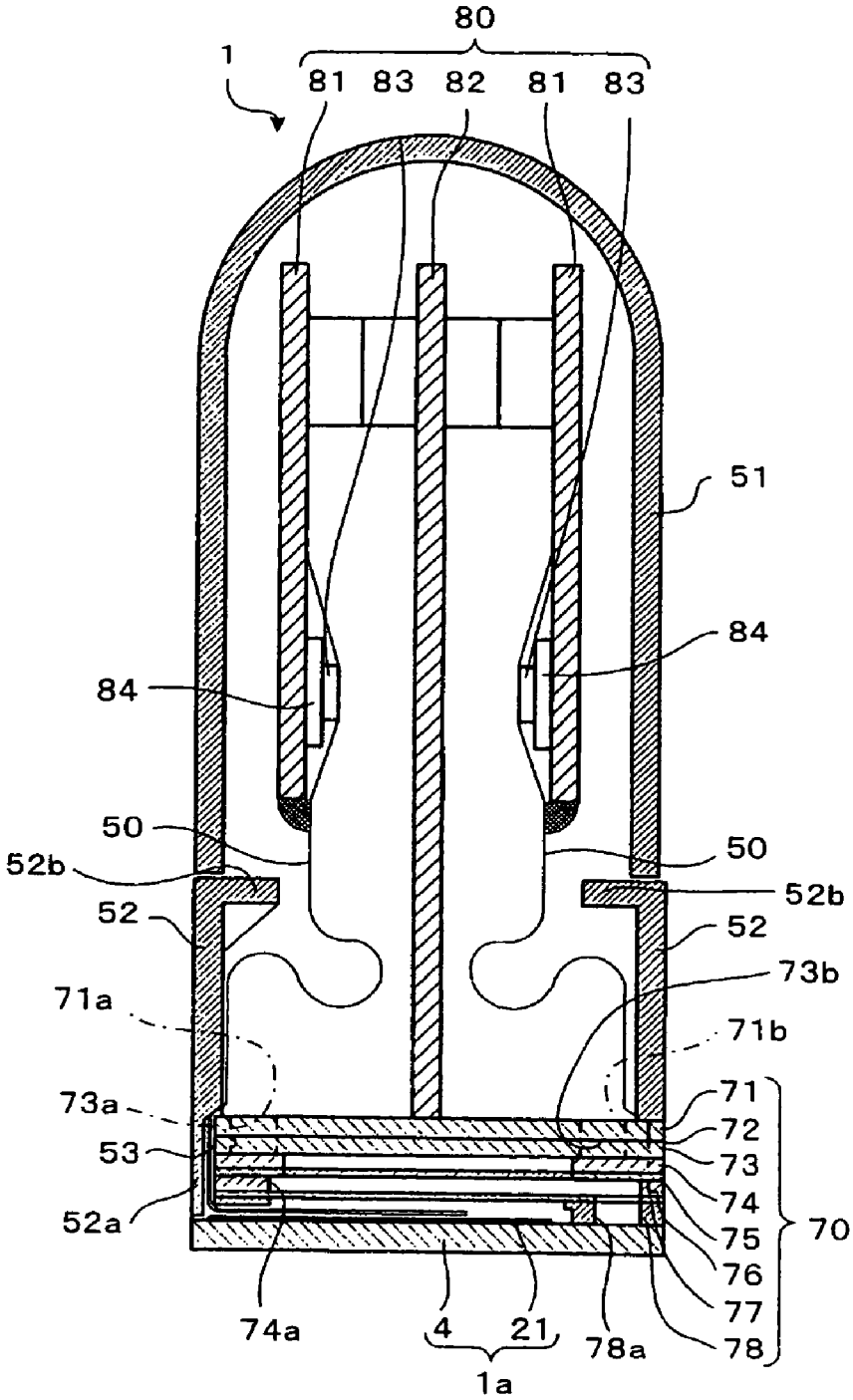
FIG. 2 is a section view of the inkjet head taken along a line II-II of FIG. 1.

FIG. 1 is an external perspective view of an inkjet head 1. FIG. 2 is a section view taken along a line II-II shown in FIG. 1.

As shown in FIGS. 1 and 2, the inkjet head 1 elongates in a main scanning direction, and has a head body 1*a*, a reservoir unit 70, and a control section 80, which controls driving of the head body 1*a*, in order from its bottom. Hereinafter, the components of the inkjet head 1 will be sequentially described with in order from its top.

The control section 80 has a main board 82, sub-boards 81 and driver ICs 83. The sub-boards 81 are placed on the both sides of the main board 82. The driver ICs 83 are fixed to side faces of the sub-boards 81 opposed to the main board 82. The driver ICs 83 generate signals for driving actuator units 21, which are included in the head body 1*a*.

The main board 82 and the sub-boards 81 have a rectangular plane elongating in the main scanning direction, and are upright in parallel to each other. The main board 82 is fixed to the upper face of the reservoir unit 70. The sub-boards 81 are placed on the both sides of the main board 82 with being separated from the main board 82 by the same distance and being upwardly separated from the reservoir unit 70. The main board 82 and the sub-boards 81 are electrically connected to each other. Heat sinks 84 are fixed to faces of the driver ICs 83 opposed to the sub-boards 81.

FPCs (Flexible Printed Circuits) 50, which function as power supplying members, are upwardly withdrawn from a lower portion of the head 1. One end of each FPC 50 is connected to the actuator units 21, and the other end of each FPC 50 is connected to one of the sub-boards 81. The FPCs 50 are connected also to the driver ICs 83 on the way from the actuator units 21 to the sub-boards 81. Namely, the FPCs 50 are electrically connected to the sub-boards 81 and the driver ICs 83 to transmit signals output from the sub-boards 81 to the driver ICs 83, and supply the driving signals output from the driver ICs 83 to the actuator units 21.

The inkjet head 1, furthermore, has an upper cover 51, which covers the control section 80; and a lower cover 52, which covers a lower portion of the head 1. The covers 51, 52 prevent inks scattering in the printing process from adhering to the control section 80, etc. In FIG. 1, the upper cover 51 is omitted so that the control section 80 can be seen.

As shown in FIG. 2, the upper cover 51 has an arched ceiling, and covers the control section 80. The lower cover 52 has a substantially rectangular cylindrical shape, which is open upward and downward, and covers a lower portion of the main board 82. An upper portion of the lower cover 52 has an upper wall 52*b*, which inwardly projects from the upper end of the sidewall. The lower end of the upper cover 51 is placed on a portion where the upper wall 52*b* is connected to the sidewall. The lower cover 52 and the upper cover 51 have a substantially same width as that of the head body 1*a*.

In the lower end of each of the sidewalls (only one of the sidewalls is shown in FIG. 1) of the lower cover 52, two projections 52*a*, which downwardly project, are formed so as to be arranged in the longitudinal direction of the lower cover 52. The projections 52*a* are accommodated in recesses 53 of the reservoir unit 70. Also, the projections 52*a* cover the portions of the FPCs 50 placed in the recesses 53. Namely, when the projections 52*a* are accommodated in the recesses 53, gaps through which the FPCs 50 can be passed are formed therebetween. The lower ends of the sidewalls of the lower cover 52 other than the projections 52*a* are contacted with the upper face of the reservoir unit 70. The tip ends of the projections 52*a* are opposed to the flow path unit 4 of the head body 1*a* with a gap therebetween for absorbing a production error.

The vicinities of one-ends of the FPCs 50 connected to the actuator units 21 horizontally elongate along the face of the flow path unit 4. The FPCs 50 are passed through the recesses 53 of the reservoir unit 70, and are upwardly withdrawn out while forming bent portions.

Figure 3:
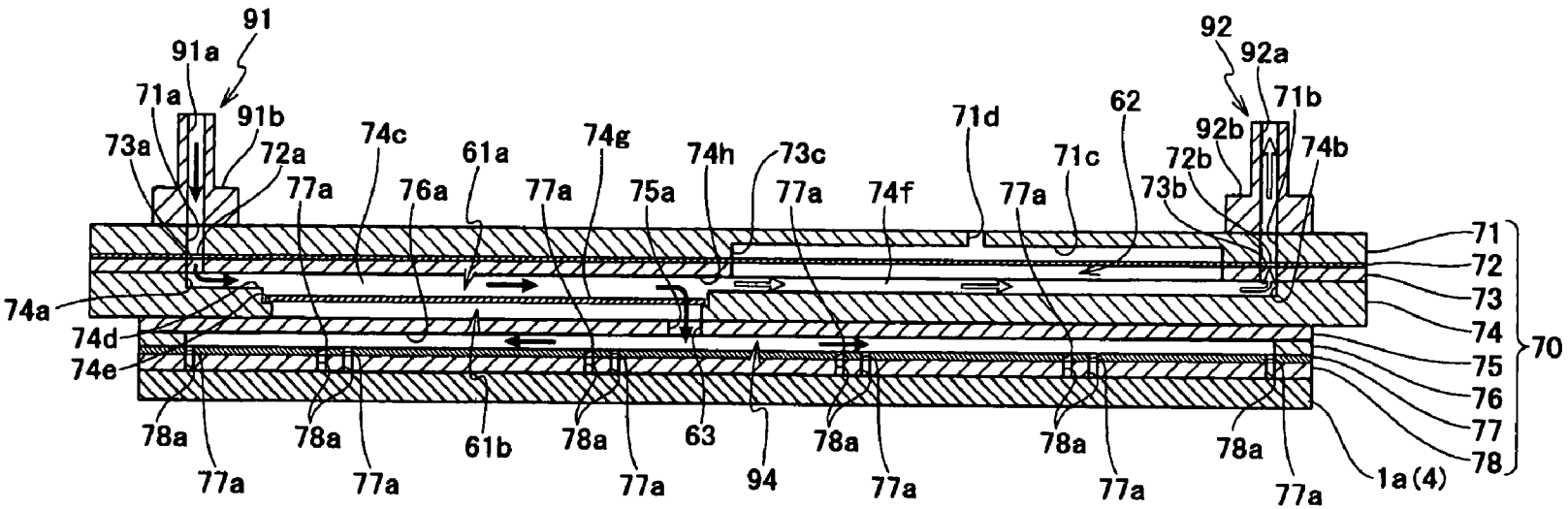
FIG. 3 is a section view of a reservoir unit and a head body, which are shown in FIG. 1, taken along a main scanning direction.

Next, the reservoir unit 70 will be described with further reference to FIGS. 3 and 4. FIG. 3 is a section view of the reservoir unit 70 and the head body 1*a* taken along the main scanning direction. FIG. 4 is an exploded plan view of the reservoir unit 70. In FIG. 3, for the sake of convenience in description, the scale in the vertical direction is expanded, and an ink flow path in the reservoir unit 70, which is not usually shown in a section taken along the same line, is shown arbitrarily.

The reservoir unit 70 temporarily stores ink, and supplies the ink to the flow path unit 4 of the head body 1*a*. As shown in FIG. 4, the reservoir unit 70 has a laminated structure in which seven plates 71, 73, 74, 75, 76, 77, and 78 that have a rectangular plane elongating in the main scanning direction (see FIG. 1), and one damper sheet 72 are stacked. The seven plates 71, 73 to 78 are plates of a metal such as stainless steel.

Figure 4A:
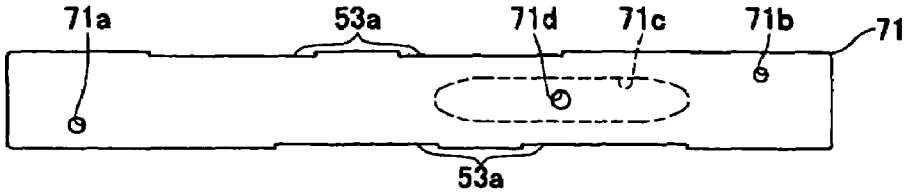
FIG. 4 is an exploded plan view of the reservoir unit shown in FIG. 3.

In the uppermost first plate 71, as shown in FIGS. 3 and 4A, circular holes 71*a*, 71*b* are formed in the vicinities of one and other ends in the longitudinal direction of the first plate 71, respectively. The circular holes 71*a*, 71*b* are placed in positions, which are deviated from the center in the width direction of the first plate 71 toward the one and other ends in the width direction. An oval recess 71*c*, which elongates in the longitudinal direction of the first plate 71, is formed in the lower face (the face on the side of the damper sheet 72) of the first plate 71. The oval recess 71*c* is positioned between the center in the longitudinal direction of the first plate 71 and the circular hole 71*b*. Furthermore, a circular hole 71*d* is formed in the center of the bottom of the oval recess 71*c*. The oval recess 71*c* cooperates with the damper sheet 72, which will be described below, to constitute a damper chamber.

Figure 4B:
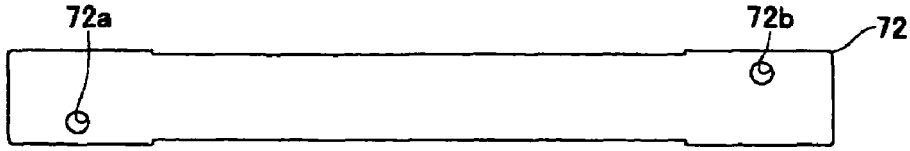

The damper sheet 72, which is the second layer from the top, is made of a flexible thin film member. As shown in FIGS. 3 and 4B, circular holes 72*a*, 72*b* corresponding to the circular holes 71*a*, 71*b* formed in the first plate 71 are formed in the damper sheet 72. A material of the flexible thin film member may be a metal, a resin, or the like, and is not restricted so long as it can easily bend in accordance with pressure variation in the ink. In this embodiment, used is a composite resin film in which a gas barrier film is added to a PET (polyethylene terephthalate) resin that originally has an excellent gas barrier property. According to this configuration, transmission of air or steam through the flexible thin film member is very suppressed, and the flexible thin film member functions also as an excellent damper against pressure variation in the ink.

Figure 4C:
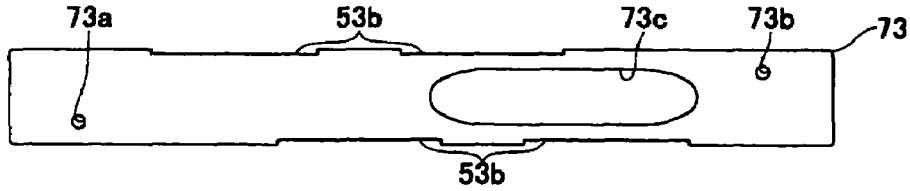

As shown in FIGS. 3 and 4C, circular holes 73*a*, 73*b* corresponding to the circular holes 71*a*, 71*b* formed in the first plate 71, and an oval hole 73*c* corresponding to the oval recess 71*c* formed in the first plate 71 pass through the third plate 73, which is the third layer from the top. The oval recess 71*c* and the oval hole 73*c* have a substantially identical shape in a plan view, and a substantially same size.

Figure 4D:
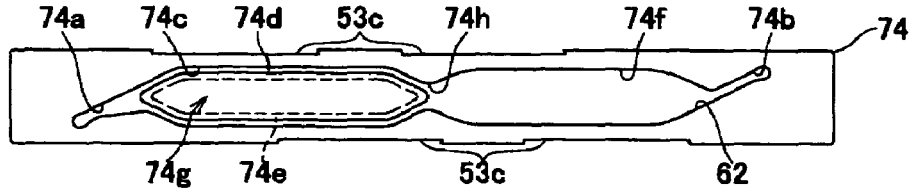

In the fourth plate 74, which is the fourth layer from the top, as shown in FIGS. 3 and 4D, thin recesses 74*a*, 74*b* are formed to elongate toward the center in the short side direction (width direction) of the fourth plate 74 from regions corresponding to the circular holes 71*a*, 71*b* formed in the first plate 71. Furthermore, an oval hole 74*c*, which elongates to the center of the fourth plate 74 while communicating with the thin recess 74*a*, is formed in the fourth plate 74. Two step faces 74*d*, 74*e*, which have different heights, are formed in the peripheral portion of the oval hole 74*c*. A filter 74*g*, which removes dust and the like in the ink, is placed on the step face 74*e*, which is lower than the step face 74*d*. Furthermore, an oval recess 74*f*, which elongates to the center of the fourth plate 74 while communicating with the thin recess 74*b*, is formed in the fourth plate 74. The oval recess 74*f*, which is formed concavely, has a shape and size substantially identical with those of the oval hole 73*c* of the third plate 73, and is open on the side of the third plate 73. The bottom faces of the thin recesses 74*a*, 74*b*, and those of the step face 74*d* and the oval recess 74*f* are formed on the same plane. A damper communication port 74*h* is formed in a sidewall in the vicinity of the center of the fourth plate 74. The oval hole 74*c* and the oval recess 74*f* communicate with each other through the damper communication port 74*h*. The thin recess 74*a*, and the portion of the oval hole 74*c* located on the side of the plate 73 with respect to the step face 74*e* form an upstream ink reservoir 61*a*. The oval recess 74*f* and the thin recess 74*b* form a damper flow path 62.

Figure 4E:
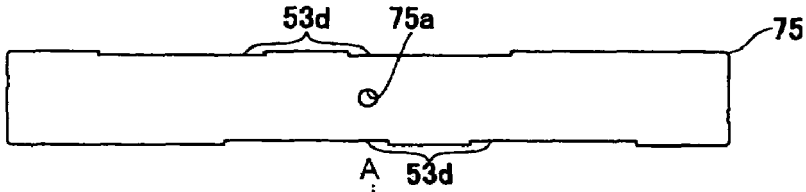

As shown in FIGS. 3 and 4E, a circular hole 75*a* is formed in the center of the fifth plate 75, which is the fifth layer from the top. The circular hole 75*a* forms a drop flow path 63. The fifth plate 75 is stacked from the lower side of the fourth plate 74 so that the circular hole 75*a* communicates with the through hole 74*c* of the fourth plate 74. The circular hole 75*a* is opposed to an acute angle portion of the through hole 74*c*, which is on the side of the center of the fourth plate 74.

Figure 4F:
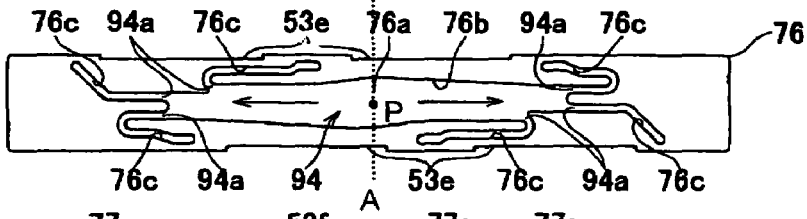

As shown in FIGS. 3 and 4F, a through hole 76*a* is formed in the sixth plate 76, which is the sixth layer from the top. The through hole 76*a* forms a reservoir flow path 94 including a main flow path 76*b*, and six tributary flow paths 76*c*, which communicate with the main flow path 76*b*. The plan shape of the reservoir flow path 94 is symmetric about a center P of the main flow path 76*b* (the center of gravity of the through hole 76*a*). The main flow path 76*b* elongates in the longitudinal direction of the sixth plate 76 with being slightly tapered as advancing from the center P of the sixth plate 76 toward the both ends in the longitudinal direction. The center P of the main flow path 76*b* in a plan view corresponds to the circular hole 75*a* of the fifth plate 75. Three tributary communication ports 94*a* are formed in the vicinity of each of the both ends in the longitudinal direction of the main flow path 76*b*. In other words, three tributary communication ports 94 are provided on each of both sides of an imaginary line A-A, which passes through the center P of the main flow path 76*a* and is perpendicular to the longitudinal direction of the reservoir unit 70. The tributary flow paths 76*c* communicate with the main flow path 76*b* via the tributary communication ports 94*a*, respectively.

Figure 5:
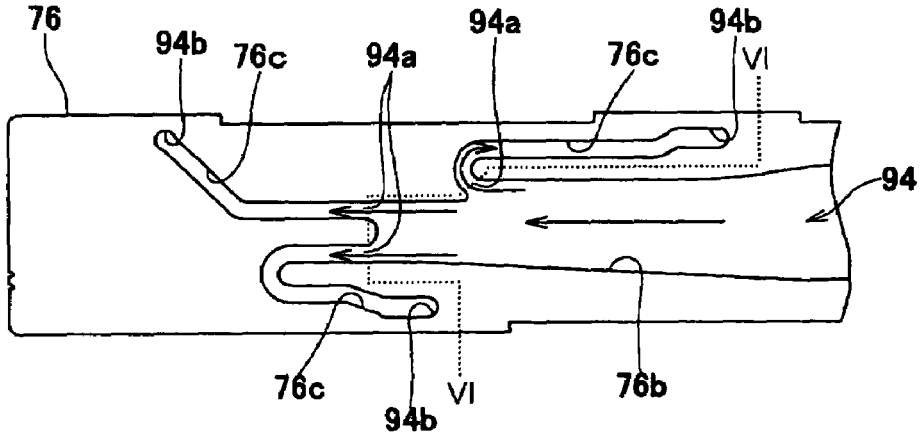
FIG. 5 is a partial enlarged view of a vicinity of one end of a reservoir flow path shown in FIG. 4F.
Figure 6:
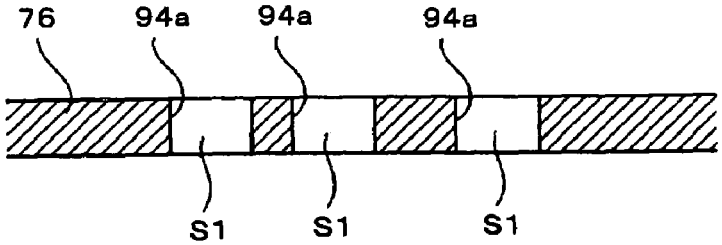
FIG. 6 is a partial section view of a plate shown in FIG. 4F, taken along a chain line VI-VI in FIG. 5.

The main flow path 76*b* and the tributary flow paths 76*c* will be described in detail with further reference to FIGS. 5 and 6. FIG. 5 is a partial enlarged view of the vicinity of one end of the reservoir flow path 94. FIG. 6 is a partial section view of the sixth plate 76 taken along a chain line VI-VI in FIG. 5. FIG. 6 shows a state where the sixth plate 76 is cut away so that the section surface is perpendicular to the ink flow direction in each tributary communication port 94*a* and that the three tributary communication ports 94*a*, which are formed in the vicinity of one end of the reservoir flow path 94, appear in the section view. As shown in FIGS. 5 and 6, all the tributary communication ports 94*a* have the same opening area S1 in the section taken along the direction perpendicular to the ink flow direction in each tributary communication port 94*a*. An ink outflow port 94*b* is formed in an end portion of each of the tributary flow paths 76*c*. A section area of each tributary flow path 76*c* along a direction perpendicular to a flow direction of the ink is approximately constant over a range from the corresponding tributary communication port 94*a* to the corresponding ink outflow port 94*b*. In all the tributary flow paths 76*c*, the length and section area along the ink flow direction are substantially identical. Therefore, the tributary flow paths 76*c* are configured so that their flow-path resistances have a substantially same value.

The region of the oval hole 74*c* of the fourth plate 74 on the side of the plate 75 with respect to the step face 74*e*, the circular 75*a* of the fifth plate 75, and the through hole 76*a* form a downstream ink reservoir 61*b*.

Figure 4G:
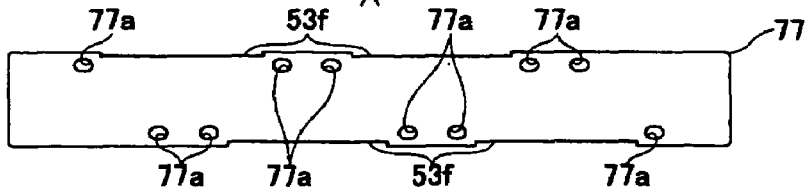

In the seventh plate 77, which is the seventh layer from the top, as shown in FIGS. 3 and 4G, a total of ten oval holes 77*a* are formed in positions corresponding to the ink outflow ports 94*b* of the tributary flow paths 76*c* formed in the sixth plate 76. Five of the oval holes 77*a* are arranged in the longitudinal direction in the vicinity of each of the width ends of the seventh plate 77. Specifically, one, two, and two holes are arranged in the one width end in order from one end side (the left side of FIG. 4G) in the longitudinal direction; and one, two, and two holes are arranged in the other width end in order from the other end side (the right side of FIG. 4G) in the longitudinal direction, so as to be separated from each other in a staggered pattern to avoid notches 53*f*, which will be described later. The one or two oval holes 77*a*, which are arranged in the staggered manner as described above, correspond to one corresponding ink outflow ports 94*b*. The oval holes 77*a* are arranged to be symmetric about the center of the seventh plate 77.

Figure 4H:
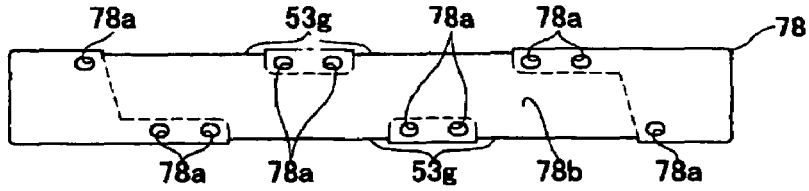

In the eighth plate 78, which is the lowermost layer, as shown in FIGS. 3 and 4H, oval holes 78*a* corresponding to the oval holes 77*a* formed in the seventh plate 77 are formed. In the lower face of the eighth plate 78, peripheral portions (portions enclosed by the broken lines in the figure) of the oval holes 78*a* project downwardly. Only the projected portions are fixed to the upper face of the flow path unit 4, and the portion other than the projected portions is separated from the flow path unit 4 (see FIG. 2).

As shown in FIG. 3, the seven plates 71, 73 to 78 and the one damper sheet 72 are stacked and fixed to each other while being positioned, to thereby configure the reservoir unit 70 according to this embodiment. As seen from FIG. 4, the four plates 71 to 74 are longer in the longitudinal direction than the remaining plates 75 to 78. The inkjet head 1 can be fixed to a fixing portion (not shown) of the printer with using the both end portions of the plates 71 to 74.

In the both ends of each of the plates 71, 73 to 78 in the width direction, as shown in FIGS. 4A to 4H, two and two, that is, a total of four rectangular notches 53*a* to 53*g* are arranged in the longitudinal direction in a staggered pattern. As result of vertically positioning the plates 71, 73 to 78 and the damper sheet 72 with each other, the recesses 53 (see FIG. 1), which pass through the reservoir unit 70 in the stack direction, are defined by the notches 53*a* to 53*g*. The width of the reservoir unit 70 except the recesses 53 is substantially identical with that of the flow path unit 4.

Next, the ink flow in the reservoir unit 70 when the ink is supplied will be described.

As shown in FIG. 3, a supply joint 91 and a discharge joint 92 are fixed to the positions of the upper face of the first plate 71 where the circular holes 71*a*, 71*b* are formed. The joints 91, 92 are cylindrical members, which include base ends 91*b*, 92*b* having a slightly larger outer diameter. Openings of cylindrical spaces 91*a*, 92*a* in the lower faces of the base ends 91*b*, 92*b* are arranged on the upper face of the first plate 71 so as to coincide with the openings of the circular holes 71*a*, 71*b* of the first plate 71, respectively. Hereinafter, the flow (indicated by the solid arrows in FIG. 3) of the ink, which is supplied through the supply joint 91, in the reservoir unit 70 will be described.

As indicated by the solid arrows in FIG. 3, the ink, which has flown into the circular holes 71*a* through the cylindrical space 91*a* of the supply joint 91, flows into the upstream ink reservoir 61*a* through the circular holes 72*a*, 73*a*. The ink, which has flown into the upstream ink reservoir 61*a*, flows into the damper flow path 62 through the damper communication port 74*h*, and also passes through the filter 74*g* to flow into the downstream ink reservoir 61*b*. In the downstream ink reservoir 61*b*, the inflow ink drop through the drop flow path 63 of the fifth plate 75 into the center P of the main flow path 76*b* of the reservoir flow path 94 of the sixth plate 76. As indicated by the arrows in FIG. 4F, thereafter, ink flows with directing from the substantial center of the main flow path 76*b* to the both ends in the longitudinal direction of the main flow path 76*b*. As indicated by the arrows in FIG. 5, the ink, which has reached the vicinities of the both ends in the longitudinal direction of the main flow path 76*b*, flows into the tributary flow paths 76*c* through the tributary communication ports 94*a*. At this time, since all the tributary communication ports 94*a* are open in the ink flow direction and have the same opening area S1, the same amount of ink flows uniformly at the same speed into all of the tributary flow paths 76*c* through the tributary communication ports 94*a*. The ink, which has flown into the tributary communication ports 94*a*, flows into ink supply ports 5*b* (see FIG. 7), which are open in the upper face of the flow path unit 4, through the ink outflow ports 94*b* and the oval holes 77*a*, 78*a*. At this time, whenever the ink passes through any one of the tributary flow paths 76*c*, the resistance of the flow path extending from a substantial center of the main flow path 76*b* in a plan view to a manifold flow path 5 is substantially identical. As described later, the ink, which has flown into the flow path unit 4, is distributed into a plurality of individual ink flow paths 32, which communicate with the manifold flow path 5, and then reaches nozzles 8, which are terminal ends of the individual ink flow paths 32, to be discharged to the outside. Namely, in the process of filling the flow paths extending from the supply joint 91 to the nozzles 8 with ink, air accumulation does not stay in the course of the flow paths. This is caused by the configuration in which the resistance of the flow path extending from a substantial center of the main flow path 76*b* to the manifold flow path 5 is substantially identical.

In this way, the ink is temporarily stored in the upstream ink reservoir 61*a* and the downstream ink reservoir 61*b*. The opening of the circular hole 71*a* in the upper face of the first plate 71 functions as an ink inflow port of the upstream ink reservoir 61*a*, and the circular holes 71*a*, 72*a*, 73*a* function as an ink inflow path.

Next, the flow (indicated by the open arrows in FIG. 3) of the ink, which is discharged in reverse purge through the discharge joint 92, will be described. Reverse purge is a process in which an ink or washing liquid is injected under pressure from the nozzles 8, supplied along a flow path in a direction opposite to the ink flow path in the normal printing operation, and then discharged from the inkjet head 1. By this reverse purge, the interior of the inkjet head 1 can be washed away (that is, foreign substances such as dust, air bubbles, and the like staying in the inkjet head 1 can be removed away).

In the reverse purge, the washing liquid flows into the reservoir unit 70 through the ink supply ports 5*b* of the flow path unit 4. The washing liquid flowing into the reservoir unit 70 reaches the downstream ink reservoir 61*b* through the oval holes 78*a*, 77*a*, passes through the filter 74*g*, and flows into the upstream ink reservoir 61*a*. As indicated by the open arrows in the figure, the washing liquid flowing into the upstream ink reservoir 61*a* is discharged from the discharge joint 92 through the damper flow path 62 and the circular holes 73*b*, 72*b*, 71*b*. At this time, an ink existing in the flow path unit 4 and the reservoir unit 70 is pushed by the washing liquid and discharged together with the washing liquid. Also, foreign substances caught by the filter 74*g* are discharged, and therefore cleaning of the flow path and recovery of the filter performance are achieved.

As shown in FIG. 3, the third plate 73 serves as a flow path wall, which defines the damper flow path 62, and the opening of the oval hole 73*c*, which is formed in the flow path wall, is covered by the damper sheet 72. The region of the damper sheet 72, which covers the opening of the oval hole 73*c*, is opposed to the oval recess 71*c* of the first plate 71. The space, which is defined by the damper sheet 72 and the oval recess 71*c*, forms a damper chamber, and the damper chamber communicates with the atmosphere via the circular hole 71*d*. Namely, the damper sheet 72 is interposed between the ink in the damper flow path 62 and the atmosphere. Even when pressure variation occurs in the ink filling the reservoir unit 70, therefore, the pressure variation can be attenuated by vibration of the damper sheet 72. Furthermore, excess displacement of the damper sheet 72 toward the oval recess 71*c* is restricted by the bottom of the oval recess 71*c*, and therefore the damper sheet 72 is prevented from being damaged. The bottom of the oval recess 71*c* prevent an external force, which may break the damper sheet 72, from being applied to the damper sheet 72.

Figure 7:
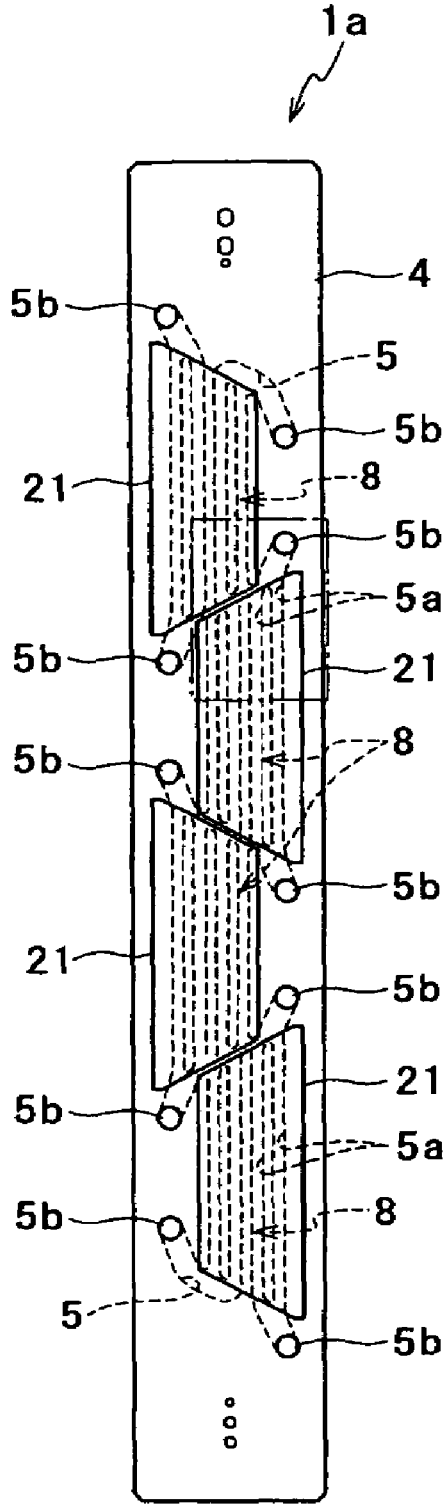
FIG. 7 is a plan view of the head body shown in FIG. 1.
Figure 8:
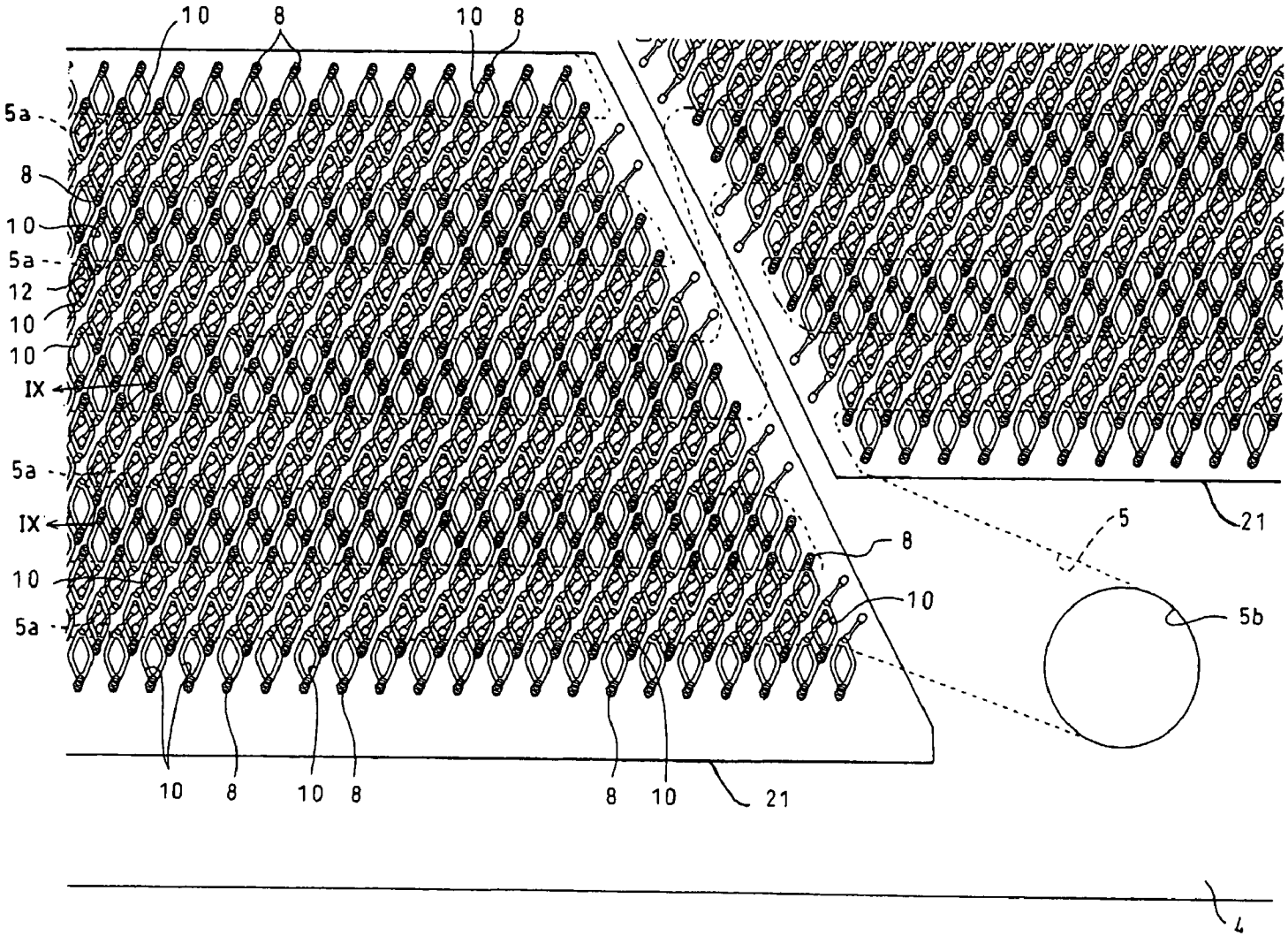
FIG. 8 is an enlarged view of a region enclosed by a one-dot chain line in FIG. 7.
Figure 9:
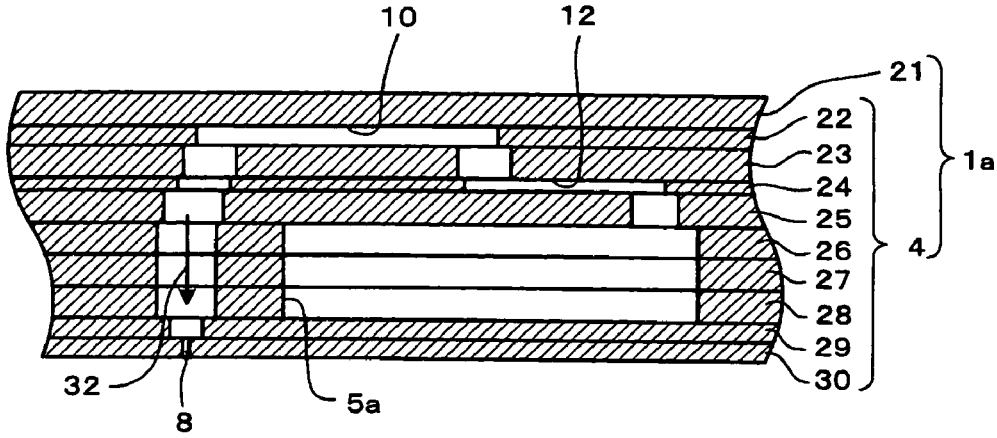
FIG. 9 is a partial section view taken along a line IX-IX in FIG. 6.
Figure 10:
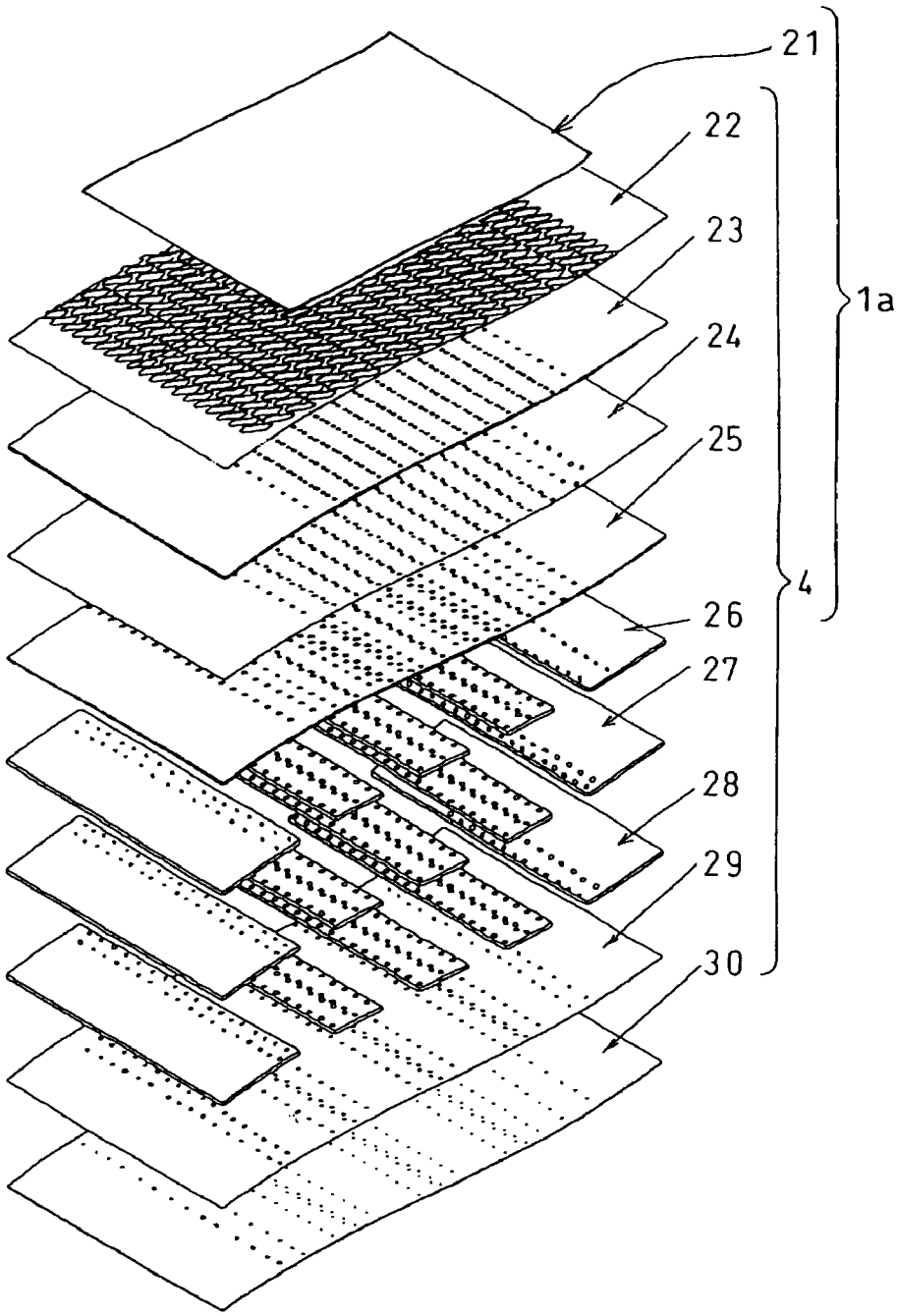
FIG. 10 is a partial exploded perspective view of the head body shown in FIG. 1.
Figure 11A:
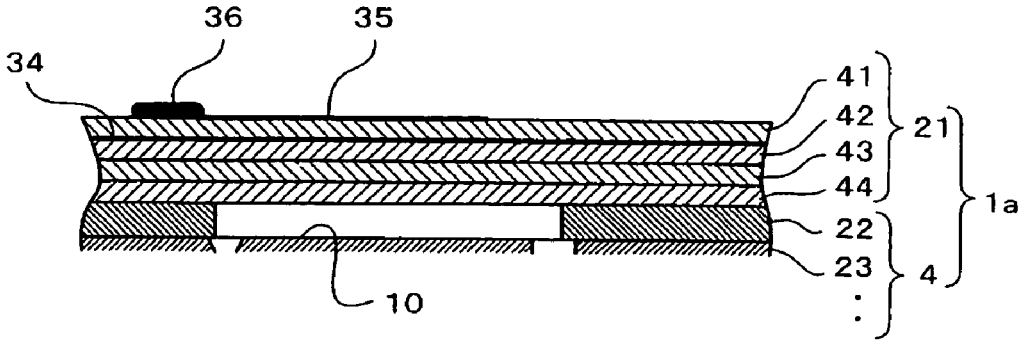
FIG. 11A is an enlarged section view of an actuator unit shown in FIG. 9.
Figure 11B:
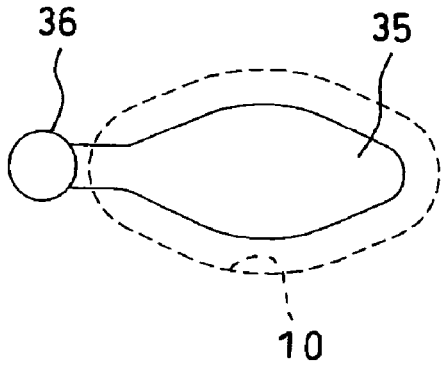
FIG. 11B is a plan view showing an individual electrode placed on a surface of the actuator unit in FIG. 11A.

Next, the head body 1*a* will be described with reference to FIGS. 7 to 11. FIG. 7 is a plan view of the head body 1*a*. FIG. 8 is an enlarged view of a region enclosed by a one-dot chain line in FIG. 7. In FIG. 8, for the sake of convenience in description, pressure chambers 10 and apertures 12 which are located below the actuator units 21, and which are to be drawn by broken lines are drawn by solid lines. FIG. 9 is a partial section view taken along a line IX-IX shown in FIG. 8. FIG. 10 is a partial exploded perspective view of the head body 1*a*. FIG. 11A is an enlarged section view of the actuator unit 21, and FIG. 11B is a plan view showing an individual electrode disposed on the surface of the actuator unit 21 in FIG. 11A.

As shown in FIG. 7, the head body 1*a* includes the flow path unit 4 and the four actuator units 21 fixed to the upper face of the flow path unit 4. The actuator units 21 have a function of selectively applying an ejection energy to the inks in the pressure chambers 10 formed in the flow path unit 4.

The flow path unit 4 has a substantially rectangular parallelepiped external shape which has an approximately same width as the reservoir unit 70 and which has the length in main scanning direction slightly shorter than that of the reservoir unit 70. On the lower face of the flow path unit 4, as shown in FIGS. 8 and 9, ink ejection faces in each of which many nozzles 8 are arranged in a matrix are formed. In each of the fixing faces between the flow path unit 4 and the actuator units 21, also the pressure chambers 10 are arranged in a large number in a matrix in a similar manner to the nozzles 8.

As shown in FIG. 10, the flow path unit 4 is configured by nine metal plates which are a cavity plate 22, a base plate 23, an aperture plate 24, a supply plate 25, manifold plates 26, 27, 28, a cover plate 29, and a nozzle plate 30 in order from its top. These plates 22 to 30 have a rectangular plane, which elongates in the main scanning direction (see FIG. 1).

In the cavity plate 22, through holes which correspond to the ink supply ports 5*b* (see FIG. 7), and rhombic through holes which correspond to the pressure chambers 10 are formed in a large number. In the base plate 23, for each of the pressure chambers 10, a communication hole between the pressure chamber 10 and the aperture 12, and that between the pressure chamber 10 and the nozzle 8 are formed; and communication holes between the ink supply ports 5*b* and the manifold flow path 5 are formed. In the aperture plate 24, for each of the pressure chambers 10, a through hole corresponding to the aperture 12, and a communication hole between the pressure chamber 10 and the nozzle 8 are formed; and communication holes between the ink supply ports 5*b* and the manifold flow path 5 are formed. In the supply plate 25, for each of the pressure chambers 10, a communication hole between the aperture 12 and a sub-manifold flow path 5*a*, and a communication hole between the pressure chamber 10 and the nozzle 8 are formed; and communication holes between the ink supply ports 5*b* and the manifold flow path 5 are formed. In the manifold plates 26, 27, 28, for each of the pressure chambers 10, communication holes between the pressure chamber 10 and the nozzle 8, and through holes which, when the plates are stacked, communicate with each other to be formed as the manifold flow path 5 and the sub-manifold flow path 5*a* are formed. In the cover plate 29, for each of the pressure chambers 10, a communication hole between the pressure chamber 10 and the nozzle 8 is formed. In the nozzle plate 30, for each of the pressure chambers 10, a hole corresponding to the nozzle 8 is formed.

The nine plates 22 to 30 are stacked and fixed to each other while being positioned so that the individual ink flow paths 32 such as shown in FIG. 9 are formed in the flow path unit 4.

As shown in FIG. 7, a total of ten ink supply ports 5*b* are open in positions corresponding to the oval holes 78*a* (see FIG. 4H) of the reservoir unit 70 in the upper face of the flow path unit 4. Inside the flow path unit 4, the manifold flow path 5 communicating with the ink supply ports 5*b*, and the sub-manifold flow path 5*a* branched from the manifold flow path 5 are formed. For each of the nozzles 8, the individual ink flow path 32 such as shown in FIG. 8 which passes from the manifold flow path 5 through the sub-manifold flow path 5*a*, the outlet of the sub-manifold flow path 5*a*, and the pressure chamber 10 to reach the nozzle 8 is formed. The ink, which is supplied from the reservoir unit 70 into the flow path unit 4 through the ink supply ports 5*b*, is branched from the manifold flow path 5 to the sub-manifold flow path 5*a*, and reaches the nozzle 8 via the aperture 12, which functions as an orifice, and the pressure chamber 10.

As shown in FIG. 7, the four actuator units 21 have a trapezoidal plan shape, and placed in a staggered pattern so as to avoid the ink supply ports 5*b* opened in the upper face of the flow path unit 4. The above-mentioned ink ejection faces correspond to regions of the lower face of the flow path unit 4 corresponding to bonding regions of the actuator units 21. In this embodiment, namely, the ink ejection face in which the nozzles 8 are open in the matrix, and the face in which the pressure chambers 10 are arranged in the matrix constitute a pair of opposing faces of the flow path unit 4. The plurality of individual ink flow paths 32 are formed in the flow path unit 4 so as to be interposed between the pair of faces. The parallel opposing edges of each actuator unit 21 elongate along the longitudinal direction of the flow path unit 4. Oblique edges of adjacent actuator units 21 overlap with each other with respect to the width direction of the flow path unit 4. The four actuator units 21 have a relative positional relationship in which the actuator units 21 are separated by the same distance from the center of the flow path unit 4 in the width direction toward the opposite sides.

The actuator units 21 are fixed to portions of the upper face of the flow path unit 4 opposed to and separated from the lower face of the reservoir unit 70 (see FIG. 2). The FPCs 50 are fixed onto the actuator units 21, but are not in contact with the lower face of the reservoir unit 70.

Each of the actuator units 21 is configured by four piezoelectric sheets 41, 42, 43, 44, which are made of a ferroelectric ceramic material of lead zirconate titanate (PZT), and which have a thickness of about 15 μm (see FIG. 11A). The piezoelectric sheets 41 to 44 are arranged over the many pressure chambers 10, which are formed correspondingly with one ink ejection face.

Individual electrodes 35 are formed in positions corresponding to the pressure chambers 10, on the uppermost piezoelectric sheet 41. A common electrode 34 which is formed over the whole sheet and which has a thickness of about 2 μm is interposed between the uppermost piezoelectric sheet 41 and the piezoelectric sheet 42, which is below the piezoelectric sheet 41. The individual electrodes 35 and the common electrode 34 are made of a metal material such as Ag—Pd. No electrode is placed between the piezoelectric sheets 42, 43, and the piezoelectric sheets 43, 44.

Each of the individual electrodes 35 has a thickness of about 1 μm and has, as shown in FIG. 11B, a substantially rhombus plan shape, which is similar to the plan shape of the pressure chambers 10. One of the acute angle portions of the individual electrode 35 having the substantially rhombus shape elongates. The elongated tip end of each individual electrode 35 is electrically connected to a circular land 36, which has a diameter of about 160 μm. The land 36 is made of gold which contains, for example, a glass frit. As shown in FIG. 11A, the land 36 is formed in a position, which is on the elongated portion of the individual electrode 35, and which is opposed to the wall of the cavity plate 22 defining the pressure chamber 10 with respect to the thickness direction of the piezoelectric sheets 41 to 44, i.e., in the position, which does not overlap with the pressure chamber 10. The land 36 is electrically joined to a contact disposed on the FPC 50 (see FIG. 2).

The common electrode 34 is grounded in a region, which is not shown. Therefore, the common electrode 34 is equally kept to the ground potential in a region corresponding to all the pressure chambers 10. By contrast, the individual electrodes 35 (the lands 36) are connected to the driver ICs 83 through the lands 36 and the FPCs 50, which have other independent lead lines for the individual electrodes 35, in order to enable their potentials to be selectively controlled (see FIG. 2).

Hereinafter, a method of driving the actuator units 21 will be described.

The piezoelectric sheet 41 is polarized in the thickness direction. When one of the individual electrodes 35 is set to a potential different from that of the common electrode 34, and an electric field is applied to the piezoelectric sheet 41 in the polarization direction, a portion of the piezoelectric sheet 41 to which the electric field is applied operates as an active portion, which is distorted by the piezoelectric effect. Namely, the piezoelectric sheet 41 is extended or contracted in the thickness direction, and contracted or extended in the planar direction by the piezoelectric transverse effect. By contrast, the remaining three piezoelectric sheets 42 to 44 are inactive layers, which have no region interposed between the individual electrodes 35 and the common electrode 34, and cannot be spontaneously deformed.

Namely, each of the actuator units 21 is of the so-called unimorph type in which the upper one piezoelectric sheet 41 apart from the pressure chamber 10 is formed as a layer including the active layer, and the lower three piezoelectric sheets 42 to 44 close to the pressure chambers 10 are formed as the inactive layers. As shown in FIG. 11A, the piezoelectric sheets 41 to 44 are fixed to the upper face of the cavity plate 22 defining the pressure chamber 10. When a difference in distortion in the planar direction occurs between the electric field applied portion of the piezoelectric sheet 41 and the lower piezoelectric sheets 42 to 44, therefore, the whole piezoelectric sheets 41 to 44 are deformed so as to be convexed toward the pressure chamber 10 (unimorph deformation). As a result, the volume of the pressure chamber 10 is reduced to increase the pressure in the pressure chamber 10, the ink is pushed out from the pressure chamber 10 into the nozzle 8, and the ink is ejected from the nozzle 8.

When the individual electrode 35 is thereafter returned to the same potential as the common electrode 34, the piezoelectric sheets 41 to 44 are restored to have the original flat shape, and the volume of the pressure chamber 10 is returned to the original value. In accordance with this, the ink is introduced from the manifold flow path 5 into the pressure chamber 10, and the ink is again stored in the pressure chamber 10.

As described above, according to the inkjet head 1 according to this embodiment, in the process of initially introducing the ink, the ink, which has dropped into the center P of the main flow path 76*b* from the drop flow path 63 forms flow of the ink, which flows from the center P of the main flow path 76*b* toward its both ends, and then flows in the vicinities of the both ends of the main flow path 76*b* into the tributary flow paths 76*c* through the tributary communication ports 94*a*. At this time, since the tributary communication ports 94*a* have the same opening area S1, a substantially same amount of ink flows at a substantially same speed into all of the tributary flow paths 76*c* through the tributary communication ports 94*a*. Moreover, the tributary communication ports 94*a* are open in the ink flow direction. Therefore, the ink flows more uniformly into all of the tributary flow paths 76*c*. Consequently, the difference in time periods when the ink, which has flown into the tributary flow paths 76*c*, reaches the manifold flow path 5 through the respective ink supply ports 5*b* is reduced. As a result, air accumulation is hardly formed in the tributary flow paths 76*c*.

The section area of each tributary flow path 76*c* along the direction perpendicular to the ink flow direction is approximately constant over the range from the corresponding tributary communication port 94*a* to the corresponding ink outflow port 94*b*. Moreover, the section areas of all the tributary flow paths 76*c* are substantially identical, and hence the same amount of ink flows out from the ink outflow ports 94*b* at a substantially same speed. Among all the tributary flow paths 76*c*, therefore, the difference in time periods when the ink, which has flown into the tributary flow paths 76*c*, reaches the manifold flow path 5 through the respective ink supply ports 5*b* is further reduced.

Furthermore, the number of the tributary communication ports 94*a* formed on one side of the imaginary line, which passes through the center P of the main flow path 76*b* and is perpendicular to the longitudinal direction of the reservoir unit 70, is equal to that of the tributary communication ports 94*a* formed on the other side of the imaginary line, all the tributary flow paths 76*c* have a substantially same length, and the reservoir flow path 94 is point-symmetric in a plan view. Therefore, the same amount of ink flows at a substantially same speed into all of the tributary flow paths 76*c* through the tributary communication ports 94*a*, and among all the tributary flow paths 76*c*, the difference in time period when the ink which, has flown into the tributary flow paths 76*c*, reaches the manifold flow path 5 through the respective ink supply ports 5*b* is approximately eliminated.

Whenever the ink passes through any one of the tributary flow paths 76*c*, the resistance of the flow path extending from the substantial center of the main flow path 76*b* in a plan view to the manifold flow path 5 is substantially identical. In the process of initially introducing the ink, therefore, inks flow from the tributary flow paths 76*c* into the manifold flow path 5 at a substantially same timing. Consequently, it is possible to surely prevent air accumulation from being formed in the tributary flow paths 76*c*.

Figure 12:
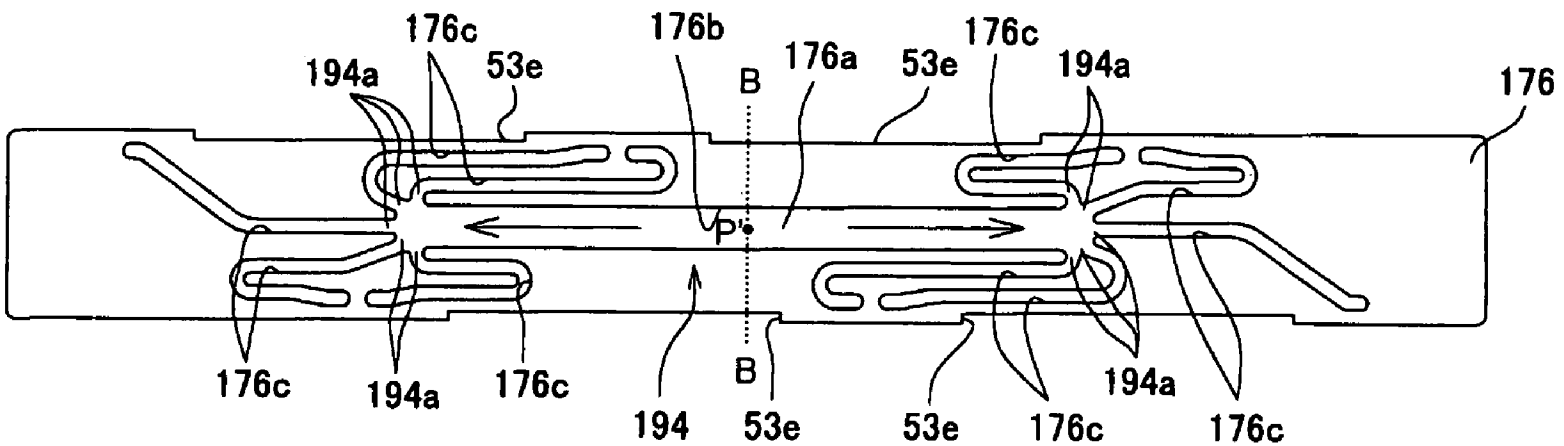
FIG. 12 is a plan view of a sixth plate constituting a part of an inkjet head according to another embodiment of the invention.
Figure 13:
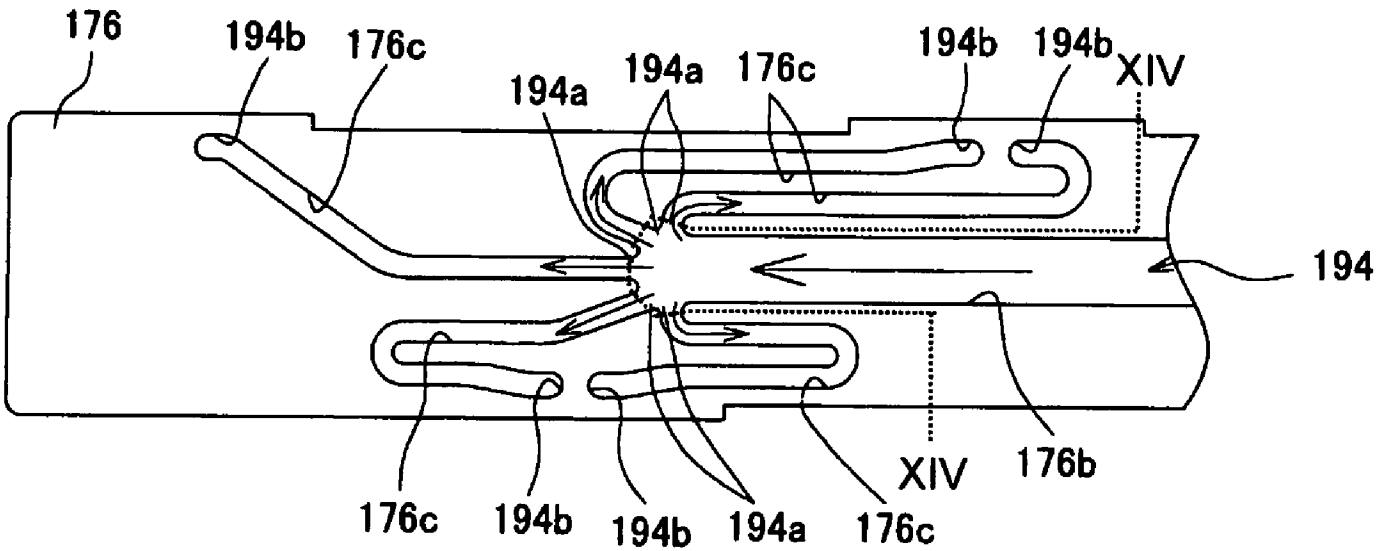
FIG. 13 is an enlarged plan view of the sixth plate shown in FIG. 12.
Figure 14:
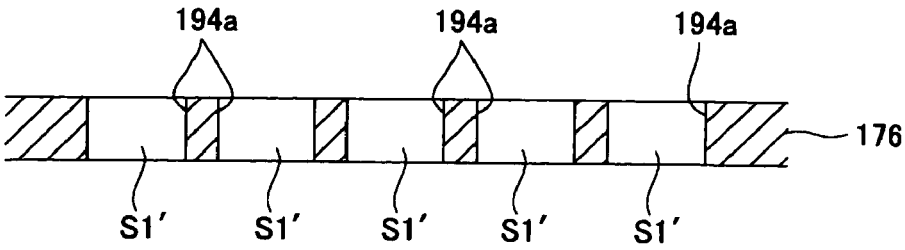
FIG. 14 is a partial section view of the sixth plate shown in FIG. 12, taken along a chain line XIV-XIV in FIG. 13.

Then, an inkjet head according to another embodiment will be described with reference to FIGS. 12 to 14. FIG. 12 is a plan view of a sixth plate 176 constituting a part of the inkjet head according to the other embodiment of the invention. In the inkjet head according to this embodiment, the above-described sixth plate 76 is replaced with the sixth plate 176 shown in FIG. 12, and the other components are identical with those described above. Therefore, components identical with those of the above-described embodiment are denoted by the same reference numerals, and their description will be omitted.

As shown in FIG. 12, a through hole 176*a* is formed in the sixth plate 176, which is the sixth layer from the top of the plurality of plates constituting the reservoir unit 70. The through hole 176*a* forms a reservoir flow path 194 including a main flow path 176*b*, and ten tributary flow paths 176*c*, which communicate with the main flow path 176*b*. The plan shape of the reservoir flow path 194 is symmetric about the center P' of the main flow path 176*b* (the center of gravity of the through hole 176*a*). The main flow path 176*b* elongates in the longitudinal direction of the sixth plate 176. In the same manner as the above-described main flow path 76*b*, the center P' of the main flow path 176*b* in a plan view corresponds to the circular hole 75*a* of the fifth plate 75. Five tributary communication ports 194*a* are formed in the vicinity of each of the both ends of the main flow path 176*b* in the elongating direction. In other words, five tributary communication ports 194*a* are provided on each of both sides of an imaginary line B-B shown in FIG. 12, which passes through the center P' of the main flow path 176*b* and is perpendicular to the longitudinal direction of the reservoir unit 70. The tributary flow paths 176*c* communicate with the main flow path 176*b* through the tributary communication ports 194*a*, respectively.

The main flow path 176*b* and the tributary flow paths 176*c* will be described in detail with further reference to FIGS. 13 and 14. FIG. 13 is an enlarged plan view of the sixth plate 176 shown in FIG. 12. FIG. 14 is a partial section view of the sixth plate shown in FIG. 12, taken along a chain line XIV-XIV in FIG. 13. FIG. 14 shows a state where the sixth plate 176 is cut away so that the section surface is perpendicular to the ink flow direction in each tributary communication port 194*a* and that the five tributary communication ports 194*a*, which are formed in the vicinity of one end of the main flow path 176*b*, appear. As shown in FIGS. 13 and 14, all the tributary communication ports 194*a* have the same opening area S1' in the section taken along the direction perpendicular to the ink flow direction in each tributary communication port 194*a*. Ink outflow ports 194*b* are formed in other end portions of the tributary flow paths 176*c*, which are connected to the tributary communication ports 194*a*, respectively. The sixth plate 176 is formed with the ten outflow ports 194*b*, which are equal in number to the ten tributary communication ports 194*a*. The outflow ports 194*b* are formed correspondingly with positions, which communicate with the ten oval holes 77*a* formed in the above-mentioned seventh plate 77. In each of the tributary flow paths 176*c*, a section area of the tributary flow path 176*c* along a direction perpendicular to the ink flow direction is approximately constant over a range from the tributary communication port 194*a* to the ink outflow port 194*b*. In all the tributary flow paths 176*c*, also the length along the ink flow direction is substantially identical. Therefore, the tributary flow paths 176*c* are configured so that their flow-path resistances have a substantially same value.

The flow of the ink, which has flown into the sixth plate 176, will be described. From the drop flow path 63 formed in the fifth plate 75, the ink flows into the center P' of the main flow path 176*b* of the reservoir flow path 194 of the sixth plate 176. As indicated by the arrows in FIG. 12, the inflow ink forms flow of ink, which flows from the substantial center of the main flow path 176*b* toward the both ends in the longitudinal direction. As shown in FIG. 13, the ink, which has reached the vicinities of the both ends of the main flow path 176*b* in the longitudinal direction flows into the tributary flow paths 176*c* through the tributary communication ports 194*a*. At this time, since all the tributary communication ports 194*a* have the same opening area S1', a substantially same amount of ink flows at a substantially same speed into all of the tributary flow paths 176*c* through the tributary communication ports 194*a*. The ink, which has flown into the tributary communication ports 194*a*, flows into the ink supply ports 5*b*, which are open in the upper face of the flow path unit 4, through the ink outflow ports 194*b* and the above-mentioned oval holes 77*a*, 78*a*.

As described above, according to the inkjet head of this embodiment, the tributary communication ports 194*a* the number of which is equal to that of the ink supply ports 5*b* are formed in the sixth plate 176 constituting a part of the reservoir unit 70, and the ink, which has passed through the tributary communication ports 194*a*, flows into the corresponding ink supply ports 5*b*. Therefore, the ink, which has once flown into one tributary communication port 194*a*, flows only into one ink supply port 5*b*. The tributary communication ports 194*a* are placed in a concentrated manner in the terminal portions of the main flow path 176*b* on its both sides in the longitudinal direction, and all of the ports 194*a* are directed toward the terminal portions of the main flow path 176*b*. Therefore, the length of the flow line, which follows the center of gravity of the through hole 176*a*, the terminal portion of the main flow path 176*b*, the tributary communication port 194*a*, and the ink outflow port 194*b* is substantially identical whenever the flow line passes through any one of the tributary flow paths 176*c*. Moreover, the flow-path resistances of the tributary flow paths 176*c* are substantially coincident with each other. Among all the tributary flow paths 176*c*, therefore, the difference in time period when the ink which has flown into the tributary flow paths 176*c* reaches the manifold flow path 5 through the respective ink supply ports 5*b* is approximately eliminated.

The tributary communication ports 194*a* are concentrated in both the terminals. In the process of initially introducing the ink, therefore, a difference in timing when ink flows into the tributary flow paths 176*c* is hardly produced among the tributary flow paths 176*c*. Air bubbles can be discharged from the inkjet head for a short time period.

In the above, the embodiments of the invention have been described. However, the invention is not limited to the above-described embodiments. The design may be variously modified within the scope of claims. For example, the embodiment is configured so that the section area of the tributary flow path 76*c* along the direction perpendicular to the ink flow direction in the main flow path 76*b* is approximately constant over a range from the tributary communication port 94*a* to the ink outflow port 94*b*, and the section areas of all the tributary flow paths 76*c* are substantially identical. Alternatively, the section area of each of the tributary flow paths may be changed on the way, or the tributary flow paths may have different section areas so long as in the process of initially introducing the ink, air accumulation does not stay in the flow paths.

In the embodiment described above, from a similar viewpoint, the lengths of all the tributary flow paths 76*c* are substantially identical. Alternatively, the tributary flow paths may have different lengths.

In the embodiment described above, the three tributary communication ports 94*a* are formed in the vicinity of each of the both ends of the main flow path 76*b* in the longitudinal direction. The number of the tributary communication ports formed in each of the ends may be a number other than three. The number of the tributary communication ports 94*a* formed in the vicinity of one end of the main flow path 76*b* in the longitudinal direction may be different from that of the tributary communication ports 94*a* formed in the vicinity of the other end. The reservoir flow path 94 is point-symmetric in a plan view. Alternatively, the reservoir flow path may not be point-symmetric.

The expressions "substantially same", "approximately constant" and similar expressions don't require strictly same and strictly constant. Those expressions may have tolerance of size, for example, ±5%. Specifically, the tributary communication ports 94*a* may have opening areas in a range of from 95% of the average opening area to 105% of the average opening area. The tributary flow paths 76*c* may have section areas in a range of from 95% of the average section areas to 105% of the average section areas. The tributary flow paths 94*a* may have lengths in a range of 95% of the average length to 105% of the average length. Flow paths extending from the substantial center of the main flow path 76*b* as viewed in the plan view through the respective tributary flow paths 76*c* to the common ink chamber 5*a* may have resistances in a range of 95% of the average resistance to 105% of the average resistance. The section area of each tributary flow path 76*c* taken along a direction perpendicular to the flow direction of the ink may fluctuate in a range of 95% of the average section area to 105% of the average section area.

In the embodiment described above, whenever the ink passes through any one of the tributary flow paths 76*c*, the resistance of the flow path extending from the substantial center of the main flow path 76*b* in a plan view to the flow path unit 4 is substantially identical. Alternatively, the resistances of the respective flow paths extending from the substantial center of the main flow path 76*b* in a plan view to the flow path unit 4 may be different so long as in the process of initially introducing the ink, air accumulation does not stay in the flow paths.

Also, for example in FIG. 5, the lower two of the tributary flow ports 94*a* are open toward the longitudinal direction of the reservoir unit 70 but the uppermost tributary flow port 94*a* isn't open toward the longitudinal direction of the reservoir unit 70. Alternatively, all of the tributary flow ports 94*a* (194*a*) may be open toward the longitudinal direction of the reservoir unit 70.

The inkjet head according to the invention is not limited to the piezoelectric type inkjet head having the actuator units 21, and may be a thermal type inkjet head, or an electrostatic type inkjet head.

The application of the inkjet head according to the invention is not limited to a printer, and the inkjet head may be applied to an inkjet facsimile apparatus or copier.

What is claimed is:

1. An inkjet head comprising:

a flow path unit that comprises:

a plurality of ink supply ports;

a common ink chamber into which ink flowing from the ink supply ports is supplied; and a plurality of individual ink flow paths each of which extends from an outlet of the common ink chamber to a nozzle through a pressure chamber; and a reservoir unit for storing the ink, the reservoir unit joined to the flow path unit so that ink stored in the reservoir unit is supplied to the common ink chamber of the flow path unit through the ink supply ports, wherein the reservoir unit comprises:

an ink inflow path formed with an ink inflow port into which the ink flows;

a reservoir flow path comprising a plurality of ink outflow ports communicating with the ink supply ports; and an ink drop flow path disposed between the ink inflow path and the reservoir flow path, the reservoir flow path comprises:

a main flow path that elongates in a longitudinal direction of the reservoir unit, the main flow path formed with a plurality of tributary communication ports; and a plurality tributary flow paths each of which is formed between a corresponding tributary communication port and a corresponding ink outflow port, a section area of the main flow path taken along a width direction of the reservoir unit is larger than each of section areas of the tributary flow paths taken along a direction perpendicular to a flow direction of ink, the ink drop flow path drops ink flowing from the ink inflow path onto a substantially center of the main flow path as viewed in a plan view, and the tributary communication ports are substantially equal to each other in an opening area, wherein the tributary communication ports and the ink outflow ports are the same in number, wherein the section area of each tributary flow path taken along the direction perpendicular to the flow direction of the ink is substantially constant over a range from the corresponding tributary communication port to the corresponding ink outflow port, and the section areas of the tributary flow paths are substantially equal to each other, and wherein each of the plurality of tributary flow paths comprises a particular portion disposed between the corresponding tributary communication port and the corresponding ink outflow port, and the particular portion of each of the tributary flow paths is parallel to a corresponding portion of the main flow path disposed adjacent to the corresponding tributary communication port.

2. The inkjet head according to claim 1, wherein the main flow path is formed with the plurality of tributary communication ports in vicinities of both end portions of the main flow path in the longitudinal direction of the reservoir unit.

3. The inkjet head according to claim 1, wherein the tributary communication ports are open toward a longitudinal direction of the reservoir unit.

4. The inkjet head according to claim 1, wherein lengths of the tributary flow paths are substantially equal to each other.

5. The inkjet head according to claim 1, wherein each of the tributary flow paths communicates with the single corresponding tributary communication port and the single corresponding ink outflow port.

6. The inkjet head according to claim 1, wherein a number of the tributary communication ports formed on one side of an imaginary line, which passes through the center of the main flow path and is perpendicular to the longitudinal direction of the reservoir unit, is equal to that of the tributary communication ports formed on the other side of the imaginary line.

7. The inkjet head according to claim 6, wherein the reservoir flow path is point-symmetric as viewed in the plan view.

8. The inkjet head according to claim 1, wherein the main flow path is symmetric about the center point of the main flow path as viewed in the plan view.

9. The inkjet head according to claim 1, wherein the center of the main flow path is a center of gravity of a combination of the main flow path and the tributary flow paths.

10. The inkjet head according to claim 1, wherein a resistance of a flow path extending from the substantial center of the main flow path as viewed in the plan view through one of the tributary flow paths to the common ink chamber is substantially equal to a resistance of another flow path extending from the substantial center of the main flow path through another of the tributary flow paths to the common ink chamber.

11. The inkjet head according to claim 1, wherein a total volume of paths from the ink inflow port to the ink outflow ports is larger than a total volume of the common ink chamber.

* * * * *